US006118405A

United States Patent [19]

Mckinnon et al.

[11] Patent Number: 6,118,405

[45] **Date of Patent: *Sep. 12, 2000**

[54] ANTENNA ARRANGEMENT

[75] Inventors: John Peter Bruce Mckinnon, Paignton; Ian Paul Llewelyn, Harlow; Peter Glanville Gwynn, Metheringham, all of United Kingdom

[73] Assignee: Nortel Networks Limited, Montreal, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 09/131,981

[22] Filed: Aug. 11, 1998

[51] Int. Cl.[7] ..... H01Q 1/38

[52] U.S. Cl. ..... 343/700 MS; 343/841

[58] Field of Search ..... 343/700 MS, 778, 343/789, 841, 872, 846, 848, 756, 909; 333/238, 246

[56] References Cited

U.S. PATENT DOCUMENTS

| | | | |
|---|---|---|---|
| 4,131,894 | 12/1978 | Schiavone | 343/700 MS |
| 4,486,758 | 12/1984 | De Ronde | 343/700 MS |
| 4,933,679 | 6/1990 | Khronopulo et al. | 343/700 MS |
| 5,001,492 | 3/1991 | Shapiro et al. | 343/700 MS |
| 5,005,019 | 4/1991 | Zaghloul et al. | 343/700 MS |
| 5,598,168 | 1/1997 | Evans et al. | 343/700 MS |

*Primary Examiner*—Tan Ho
*Attorney, Agent, or Firm*—Lee, Mann, Smith, McWilliams, Sweeney & Ohlson

[57] ABSTRACT

A radio frequency antenna arrangement comprising an array of radiating elements, such as radiating antenna patches, which are co-located in a circuit, such as a microstrip circuit, with feeder elements which couple electromagnetic radiation to the radiating elements. The antenna arrangement has an electrically conductive backplate located behind the circuit, which acts as a groundplane and which is separated from the circuit by a dielectric layer. To reduce electromagnetic interference from the feeder elements which could disrupt the antenna pattern an electrically conductive screen is located directly in front of the feeder elements of the circuit but selectively exposes the array of radiating elements. The screen is spaced from the feeder elements and is not electrically connected to the backplate so that the screen, feeder elements and backplate do not form a triplate structure.

14 Claims, 4 Drawing Sheets

ANTENNA ARRANGEMENT

FIELD OF THE INVENTION

This invention relates to radio frequency antennas having radiating elements which are co-located with feeder lines which couple electromagnetic signals to and from the radiating elements. In particular the present invention relates to radio frequency antennas having radiating patch elements which are formed integrally with feeder lines in a planar or conformal microstrip circuit.

A microstip circuit comprises two sheets of electrically conductive material, spaced apart by a dielectric substrate. One of the electrically conductive sheets is etched to provide electrically conducting feed lines and radiating patches, and in cooperation with the other of the electrically conductive sheet, which serves as a ground plane, will support transverse electromagnetic (TEM) waves.

Such antennas are commonly used in radio frequency (RF) transceivers of fixed wireless access telecommunications networks.

Known fixed wireless access telecommunications networks comprise radio transceivers which are located at subscriber's premises or at base stations. The radio transceivers at the subscribers premises communicate by radio link with the transceivers at a base station, which provides cellular radio coverage over, for example, a 5 km radius in urban environments. A typical base station will support 500–2000 subscribers. Each base station is connected to a standard PSTN switch via a conventional transmission link. Thus subscribers are connected to a national telecommunications network by radio link using a wireless telecommunication network in place of the more traditional method of copper cable.

In known antennas with radiating patches which are co-located with feeder circuitry, the design of the feeder circuitry is significantly constrained because the feeder circuitry can itself radiate RF electromagnetic radiation and can be caused to resonate by incoming RF electromagnetic radiation. The feeder elements comprise feed lines, for example microstrip feed lines, stripline feed lines or coplanar waveguide feed lines. When feeding or coupling an electromagnetic signal to the patches the feeder elements will radiate in a non-uniform manner and at different radiation polarisations and so will detrimentally modify the radiation pattern of a patch antenna. Similarly, incoming radio frequency electromagnetic signals, at different radiation polarisations can cause the feeder lines to resonate and couple spurious electromagnetic signals to the processing circuitry of the antenna. The electromagnetic interference from the radiating and resonating feeder lines can reduce the directivity and symmetry of the antenna radiation pattern, reduce the front to back sidelobe ratio of the antenna and reduce the polarisation sensitivity of the antenna. The reduction in directivity and reduction in antenna front to back sidelobe ratio will increase co-channel interference, in particular in antennas which are co-located at a base station. The reduction in polarisation sensitivity will increase co-channel interference between frequency channels which are oppositely polarised.

High impedance feeder elements and feeder elements having bends and junctions, such as T-junctions or other splits tend to generate the highest levels of interference.

In the past this problem has been overcome by making the feeder elements which are integrated onto a planar or conformal patch element circuit as short as possible and to remove the majority of the feeder element arrangement into a separate assembly. For example in U.S. Pat. No. 5,001,492 a waveguide coupling system is provided which enables the feeder circuitry to be located away from and screened from the radiating patches. This makes for a cumbersome and expensive arrangement as it is very cheap and efficient to co-locate the feeder and patch elements in an integrated planer or conformal circuit arrangement, in particular in a microstrip circuit arrangement.

Alternatively, by complying with significant design constraints, undesired electromagnetic interference from feeder elements co-located with resonating patches can be minimised, for example, by having a reduced thickness of dielectric between feeder elements and a metal groundplane backplate, by reducing the impedance of the feeder elements, by utilising continuous feeder elements (ie. low number of bends and junctions etc.) and by avoiding electrically significant lengths and widths at the frequency of interest (eg. multiple half wavelengths) in the design of feeder elements. These constraints are generally inconvenient because, for example, the thickness of dielectric layer required to substantially reduce RF electromagnetic radiation radiated by the feeding lines is so small that it is difficult and so expensive to manufacture in bulk such thin layers of dielectric to the desired tolerances.

A further problem associated with known antenna arrangements with feeder circuitry which is co-located with resonating patch elements is capacitive interaction between the feeder lines and the patch elements. This can tend to disturb the power splits in the feeder lines and leads to one or more of the patch elements being preferentially exited. This leads to distortion of the radiation pattern from the array of patch elements. This capacitive interaction can also cause one or more of the patch elements to resonate off-frequency and can require time-consuming experimentation to find the correct dimensions for the patch elements to re-tune them to the desired frequency band.

The interaction between the feeder lines and the radiating patch elements tends to be highly frequency specific which limits the bandwidth over which the patch antenna array can be successfully operated.

Accordingly to reduce electromagnetic interference from feeder elements which are co-located with radiating patches substantial practical, mechanical and electrical design constraints have to be obeyed.

OBJECT OF THE INVENTION

The present invention seeks to provide a radio frequency antenna having radiating elements which are co-located with feeder elements and which overcomes or at least mitigates one or more of the problems noted above.

In addition the present invention aims to provide a patch antenna with integrated feeder and radiating patch circuitry which has low levels of electromagnetic interference from the feeder lines without placing significant constraints on the design of the patch and feeder circuitry.

SUMMARY OF THE INVENTION

Accordingly, the present invention provides a radio frequency antenna arrangement comprising;

- at least one radiating element which is co-located in a circuit with at least one feeder element which couples electromagnetic signals to the radiating element, and
- an electrically conductive backplate located behind the circuit and separated from the circuit by a dielectric layer, wherein an electrically conductive screen is located in front of the feeder element or elements to selectively expose the radiating element or elements, which screen is not electrically connected to the backplate and is spaced from the feeder element or elements so that the screen, feeder element or elements and backplate do not form a triplate structure.

The backplate forms a groundplane for the feeder elements and radiating elements. The electrically conducting screen is not connected to ground and comprises a layer of conducting material which has a large area (relative to the wavelength at which the antenna arrangement is designed to operate). Thus, the screen acts like a capacitor to the backplate and so shorts radiation from the feeder lines down to ground and does not re-radiate it.

The screen thus intercepts most of the electromagnetic radiation radiating from the feeder elements. Similarly, most of the electromagnetic radiation incoming towards the feeder elements is intercepted by the screen and so prevented from reaching the feeder elements. As the radiating elements are the only part of the circuit which are able to radiate and to receive incoming electromagnetic radiation, the radiation pattern of the antenna arrangement is not detrimentally modified by interference from the feeder lines. Also, the polarisation sensitivity of the antenna is not prejudiced by interference from the feeder lines. Furthermore, this reduction in feeder line interference does not place any significant constraints on the design of the radiating element and feeder element circuitry.

Furthermore, the presence of the electrically conductive screen reduces the capacitive interaction between the feeder elements and radiating elements and can thus increase the bandwidth over which the antenna arrangement can be successfully operated.

It is preferred that the spacing between the screen and the feeder elements is at least three, more preferably four, times greater than the spacing between the feeder elements and the backplate. This prevents the backplate, feeder element and screen arrangement behaving like a triplate structure which would cause the screen itself to radiate and interfere with the operation of the radiating elements. The fact that the backplate and screen are not electrically connected differentiates the arrangement according to the present invention from a triplate structure.

In a preferred embodiment the screen is configured to define at least one aperture in the screen which corresponds to and lies in front of the radiating element or elements of the circuit. Thus, the radiating elements are selectively exposed so that they can radiate and receive electromagnetic signals while the feeder elements are covered and so electromagnetic signals from and to the feeder elements are intercepted to effectively remove interference from the feeder elements. Preferably, each aperture in the screen is formed with dimensions which are ⅘ to ⅔ times the equivalent dimensions of the corresponding radiating element so as to avoid using dimensions which are a multiple of half a wavelength of the radio frequencies at which the antenna circuit is arranged to operate.

The screen is preferably designed not to resonate at the frequencies at which the antenna circuit is designed to operate. Therefore, the dimensions of the screen are preferably not close to multiples of half the wavelength of the range of radio frequency radiation at which the circuit is designed to operate.

The radiating element may be a radiating antenna patch and for convenience the antenna circuit may comprise a printed microstrip circuit.

The screen may be made of metal and conveniently comprises a layer of metal painted onto a housing part of the antenna, for example, by spray painting. Thus, the screen can be incorporated in the antenna arrangement without increasing the number of components in the antenna arrangement. Alternatively, the screen may comprise a metal plate or a metal film, for example a metal film which is printed onto a thin sheet of plastics material.

According to a second aspect of the present invention there is provided a method of screening a radio frequency antenna arrangement which has at least one radiating element which is co-located in a circuit with at least one feeder element which couples electromagnetic signals to the radiating element and an electrically conductive backplate located behind the circuit and separated from the circuit by a dielectric layer, comprising the steps of;

locating an electrically conductive screen directly in front of the feeder element or elements of the antenna arrangement so as to selectively expose the radiating element or elements, electrically isolating the conductive screen from the backplate, and spacing the conductive screen from the feeder element or elements so that the screen, feeder element or elements and backplate do not act as a triplate structure.

According to a third aspect of the present invention there is provided method of operating an apparatus according to the first aspect of the present invention comprising the steps of; supplying electromagnetic signals to the circuit for transmission by the radiating elements as electromagnetic radiation and coupling electromagnetic signals from the circuit which are generated by the receipt of electromagnetic radiation by the radiating elements.

BRIEF DESCRIPTION OF THE DRAWINGS

In order that the present invention is more fully understood and to show how the same may be carried into effect, reference shall now be made, by way of example only, to the figures as shown in the accompanying drawing sheets, wherein.

DETAILED DESCRIPTION OF THE EMBODIMENTS

Figure 1:
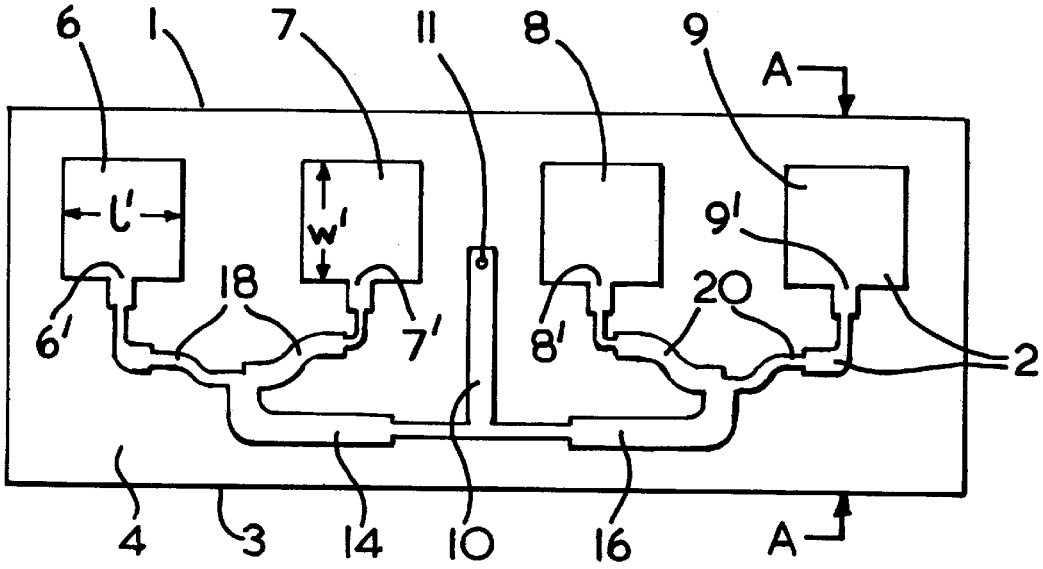
FIG. 1 shows a schematic representation of a first embodiment of a planar microstrip patch antenna with integrated feeder lines.
Figure 3:
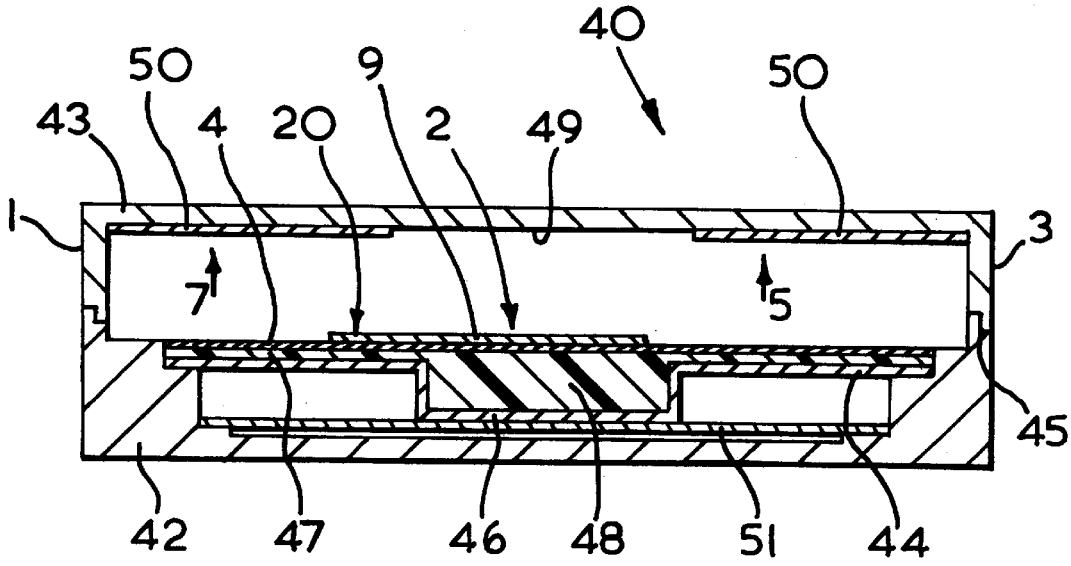
FIG. 3 shows a cross section through a first embodiment of an antenna assembly according to the present invention incorporating the circuit of FIG. 1 and the screen of FIG. 2 and taken across plane AA of FIGS. 1 and 2.

Referring to FIG. 3 which shows an antenna (40) in cross section. The antenna has a two part clamshell housing (42,43) made of, for example, injection moulded plastics material within which is supported a reflecting metal backplate (44). The backplate (44) is formed with four rectangular depressions (46) which correspond to the four microstrip resonant antenna patches (6,7,8,9) shown in FIG. 1. Over the backplate (44) is located a layer of dielectric material (47), such as polystyrene, which has a dielectric constant close to that of air. Alternatively, the layer of dielectric material (47) could comprise an air gap. The polystyrene layer (47) is formed with four rectangular raised portions (48) which fit into the depressions (46) in the reflecting backplate (44). The polystyrene layer (47) insulates the backplate (44) from the printed microstrip antenna and feeder line circuit (2) which is shown in FIG. 1 and which comprises a 37 micron thick copper film (2) printed on a backing sheet of plastic material (4). The circuit (2) comprises an array of four rectangular microstrip resonant antenna patches (6,7,8,9) which are driven in phase, for example, in the frequency range of 3.4 to 3.6 GHz.

In use the antenna is mounted with the long edges (1,3) of the antenna substantially horizontal and so the antenna shown in FIG. 1 operates with vertically polarised RF radiation. The circuit (2) is fed at feed point (11) which is electrically connected to a printed circuit board (51) located within the radome housing (42,43). The impedance matched microstrip feeder lines (10, 14, 16, 18, 20) couple the electromagnetic signal input at feed point (11) so that it is split equally into four signals which arrive in phase with each other at vertical feed points (6',7',8',9') of the patches (6,7,8,9). Similarly, incoming RF electromagnetic signals having a substantially vertical polarisation cause the patches (6,7,8,9) to resonate and the resulting electromagnetic signals are coupled, via the feeder lines (10, 14, 16, 18, 20) to feed point (11), so that they reach the feed point (11) in phase. The electromagnetic signal reaching the feed point (11) is then further processed by circuitry on the printed circuit board (51) located within the radome housing (42,43) to recover the incoming modulation signal for further transmission, for example, along a co-axial cable.

Figure 2:
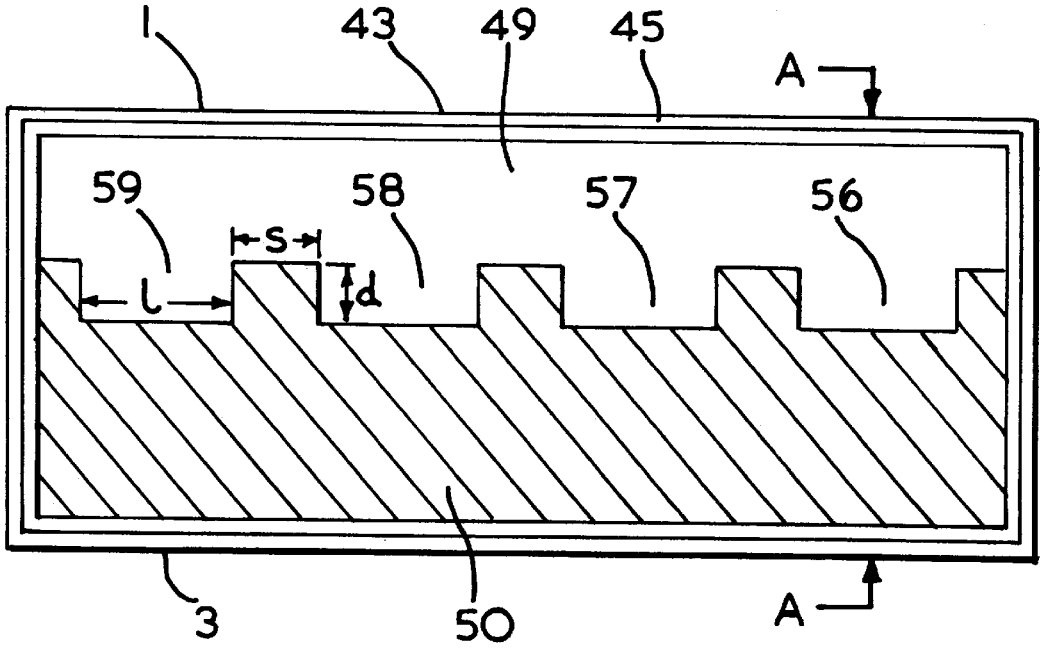
FIG. 2 shows a schematic representation of a first embodiment of a screen according to the present invention for the circuit of FIG. 1.

In FIG. 2 the upper part of the antenna housing (43) is shown from below (ie. from direction of arrows (5,7) in FIG. 3) and has a staggered rim (45) which mates with a cooperating staggered rim on the lower part of the antenna housing (42). The underside (49) of the top of the antenna housing part (43) is partially spray coated with a layer of metal (50) which forms a screen and which is shown in cross hatching in FIG. 2. The layer of metal is arranged so that when the upper housing part (43) is fitted over the lower part of the housing (42) the screen (50) lies above the feeder lines (10,14,16,18,20) but has partial windows (56, 57, 58, 59) formed in it so that the screen does not lie above the patches (6,7,8,9). For example, partial window (56) lies above patch (6), etc. The partial windows are slightly longer than the corresponding patches, for example, the length I of each of the partial windows (56,57,58,59) in the metal screen (50), is ⅗ times the length (I') of the patches (6,7,8,9) of FIG. 1. The dimensions of the metal screen (50), for example, the length I and the depth d of, and the separation s between, the partial windows (56,57,58,59) are arranged so that they do not correspond to a multiple of half the wavelength of the radiation at which the circuit (2) of FIG. 1 is arranged to operate.

The distance between the screen (50) and the feeder lines of printed circuit (2) is arranged to be five times greater than the distance between the feeder lines (eg. feeder line (20) in FIG. 3) of the printed circuit (2) and the metal backplate (44) so that the screen (50), feeder lines (10,14,16,18,20) and backplate (44) do not form a triplate structure. This means that the screen (50) does not have to be earthed and does not have to be electrically connected to the metal backplate (44) so makes this screen arrangement very simple.

During use of the antenna assembly (40) the metal screen (50) intercepts the majority of the RF electromagnetic radiation emitted by the microstrip feeder lines (10,14,16, 18,20) and so very little of it is transmitted by the antenna (40). The radiation emitted by the patches (6,7,8,9) is not affected by the presence of the screen (50) and so transmission of radiation from the patches is not impaired. Similarly, most of the incoming RF electromagnetic radiation directed towards the feeder lines (10,14,16,18,20) is intercepted by the screen (50) and so is prevented from reaching the feeder lines (10,14,16,18,20). Incoming RF electromagnetic radiation directed towards the patches (6,7,8,9) is not hindered by the screen (50).

Figure 4:
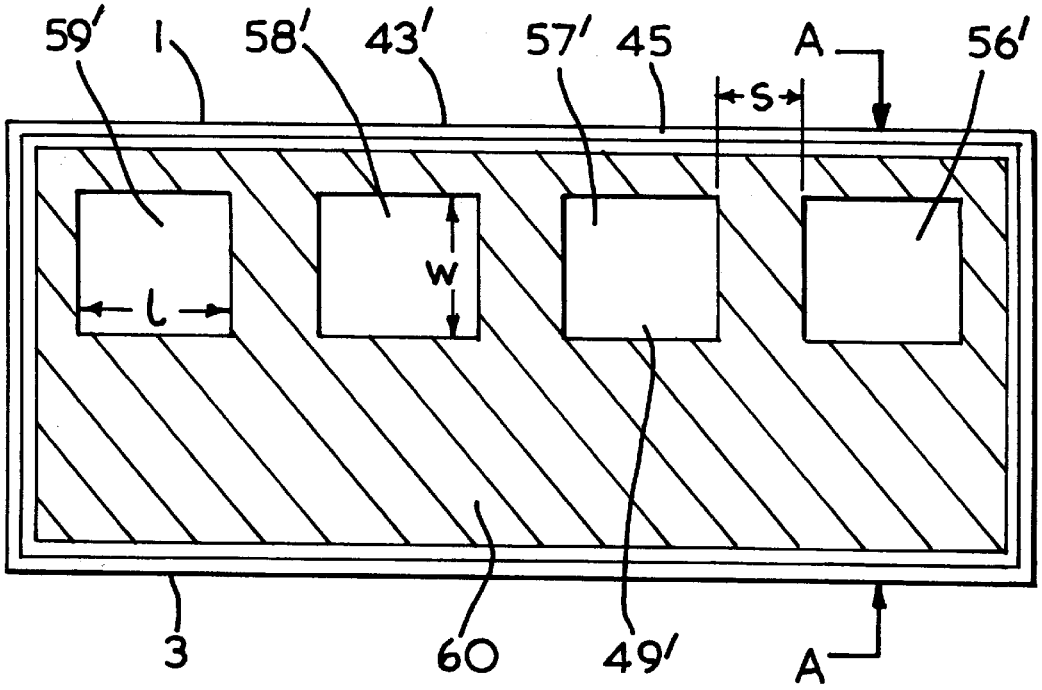
FIG. 4 shows a schematic representation of a second embodiment of a screen according to the present invention for the circuit of FIG. 1.

As an alternative to the screen (50) shown in FIG. 2 the screen (60) shown in FIG. 4 may be used. In FIG. 4 the upper part of an alternative antenna housing part (43') is shown from below (ie. from direction of arrows (5,7) in FIG. 3) similar to that shown in FIG. 2. The underside (49') of the top of the antenna housing part (43') is partially coated, for example by spray coating, with a layer of metal (60) which forms a screen and which is shown in cross hatching in FIG. 4. The layer of metal (60) is arranged so that when the upper housing part (43') is fitted over the lower part of the housing (42) the screen (60) lies above the feeder lines (10,14,16, 18,20) but has full windows (56', 57', 58', 59') formed in it so that the screen (60) does not lie above the patches (6,7,8,9). For example, window (56) lies directly above patch (6), etc. The windows are arranged to be larger than the corresponding patches, for example, length I and width w of each window (56',57',58',59') is chosen so that it is ⅗ times the length I' and width w' respectively of the patches (6,7,8,9). The dimensions of the screen (60) are chosen so that, for example, length I and the width w of the windows and the separation s between the windows (56',57',58',59') are arranged so that they do not correspond to a multiple of half the wavelength of the radiation at which the circuit (2) of FIG. 1 is arranged to operate.

During use of the antenna assembly (40) the metal screen (60) intercepts the majority of the RF electromagnetic radiation transmitted by the microstrip feeder lines (10,14, 16,18,20) and so very little of it is transmitted by the antenna (40). The radiation from the patches (6,7,8,9) is not affected by the presence of the screen (60) and so transmission of RF electromagnetic radiation from the patches is not impaired. Similarly, most of the incoming radio frequency radiation directed towards the feeder lines (10,14,16,18,20) is intercepted by the screen (60) and so prevented from reaching the feeder lines (10,14,16,18,20). Incoming radio frequency radiation directed towards the patches (6,7,8,9) is not hindered by the screen (60).

Similarly, the screen (60) is located far enough away from the feeder lines of the printed circuit (2) that the screen (60), feeder lines (10,14,16,18,20) and backplate (44) do not form a triplate structure. The screen (60) is not electrically connected to the backplate (44).

Figure 5:
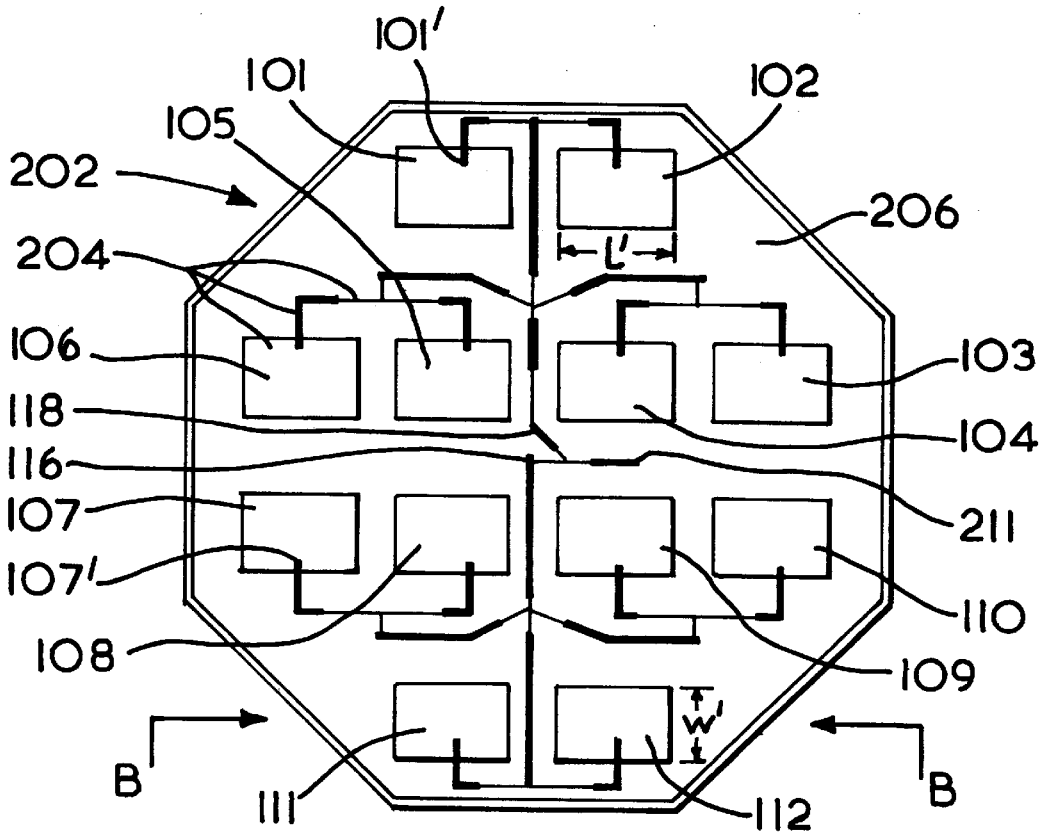
FIG. 5 shows a schematic representation of a second embodiment of a planar microstrip patch antenna with integrated feeder lines.
Figure 6:
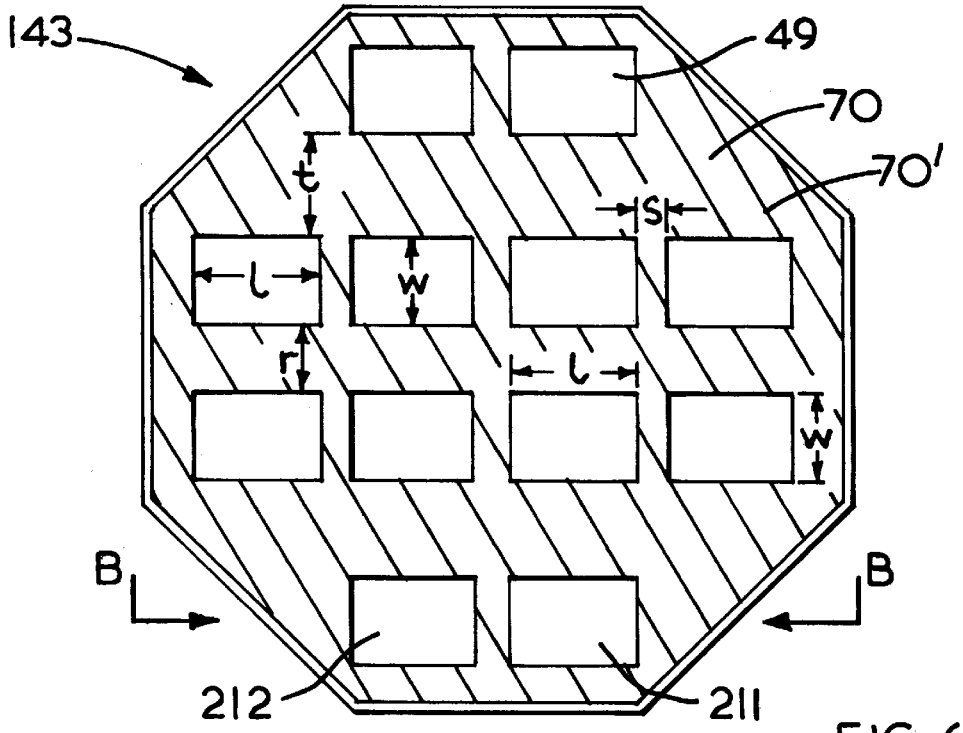
FIG. 6 shows a schematic representation of a third embodiment of a screen according to the present invention for the circuit of FIG. 5.
Figure 7:
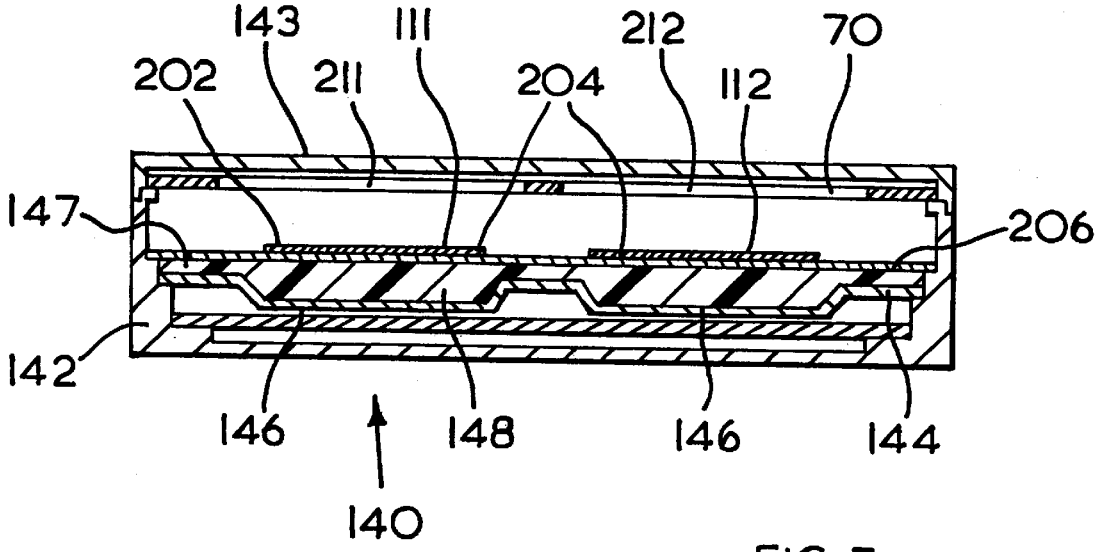
FIG. 7 shows a cross section through a second embodiment of the antenna assembly according to the present invention incorporating the circuit of FIG. 4 and the screen of FIG. 6 embodied as a metal plate and taken across plane BB of FIGS. 5 and 6.

Referring now to FIGS. 5 to 8, in which is shown a second embodiment of a patch antenna (140) according to the present invention. FIG. 7 shows the antenna (140) which has a two part clamshell housing (142,143) made of, for example, injection moulded plastics material. Within the antenna housing is supported a reflecting metal backplate (144) which is formed with twelve regular depressions (146) two of which are shown in FIG. 7. The depressions (146) correspond to the twelve microstrip resonant antenna patches (101 to 112) shown in FIG. 5. A dielectric layer (147) with raised portions (148) which correspond to the depressions (146) is located between the metal backplate (144) and a printed microstrip antenna and feeder line circuit (202) which is shown in FIG. 5. The circuit (202) comprises a 37 micron thick copper film (204) printed onto a backing sheet of plastics material (206).

The dielectric layer (147) could alternatively comprise an air gap.

The circuit (202) comprises a planar array of twelve rectangular microstrip resonant antenna patches (101 to 112) which are driven in phase. The circuit (202) is fed at feed point (211). Impedance matched microstrip feeder lines couple the signal input at feed point (211) so that it is split equally into twelve signals which are fed into the twelve respective patches. The feeder lines are arranged so that six of the signals arrive in phase with each other at the feed points (for example (101')) of patches (101 to 106) and the other six of the split signals arrive in phase with each other at the feed points (for example (107')) of patches (107 to 112) but 180° out of phase with the signals at the feed points of patches (101 to 106). This ensures that the patches effectively resonate in phase because patches (101 to 106) are fed from above and patches (107 to 112) are fed from below. The 180° relative phase change is effected by making feeder line section (116) a half a wavelength, of the average operating wavelength of the antenna (40), longer than feeder line section (118). In the orientation of the circuit (202) shown in FIG. 5, the antenna will transceive predominantly vertically polarised radiation. If the circuit (202) is rotated about its central axis through 90° it will transceive predominantly horizontally polarised radiation.

The upper part of the antenna housing (143) is shown from below in FIG. 6. The underside (49) of the upper antenna housing part (143) is covered with a metal plate (70) (See FIG. 7) or alternatively by a metal film (70') (See FIG. 8) which is supported in the housing part (143) and which forms a screen (which is shown in cross hatching in FIG. 6). The plate of metal (70) or the metal film (70') are arranged so that when the upper housing part (143) is fitted over the lower housing part (142) the screen (70,70') lies above the feeder lines of the circuit (202), but has windows (for example 211,212) formed in it so that the screen does not lie directly above the patches (101 to 112). For example, window (211) lies above patch (111) and window (212) lies above patch (112) etc. The windows are slightly larger than the patches, for example the length I and width w of the windows is ⅔ times the length I' and width w' respectively of the patches (101 to 112). The dimensions of the screen (70, 70'), for example, the length (I), width (w) of the windows and spacing (r,s,t) between the windows are arranged so that they do not correspond to a multiple of half the wavelength of the radiation at which the circuit (202) of FIG. 5 is arranged to operate. The screen (70,70') is located far enough away from the feeder lines of the printed circuit (202) that the screen (70,70'), feeder lines and backplate (144) do not form a triplate structure. The screen (70,70') is not grounded and is not electrically connected to the backplate (144).

During use of the antenna assembly (140) the metal screen (70,70') intercepts the majority of the radio frequency radiation emitted by the microstrip feeder lines of the circuit (202) and most of the incoming radio frequency radiation directed towards the feeder lines of the circuit (202) is intercepted by the screen (70,70') and so prevented from reaching the feeder lines. However, the windows (eg. 211, 212) in the screen do not impede the radiation emitted by the patches (101 to 112) or impede incoming radiation directed towards the patches (101 to 112).

Figure 8:
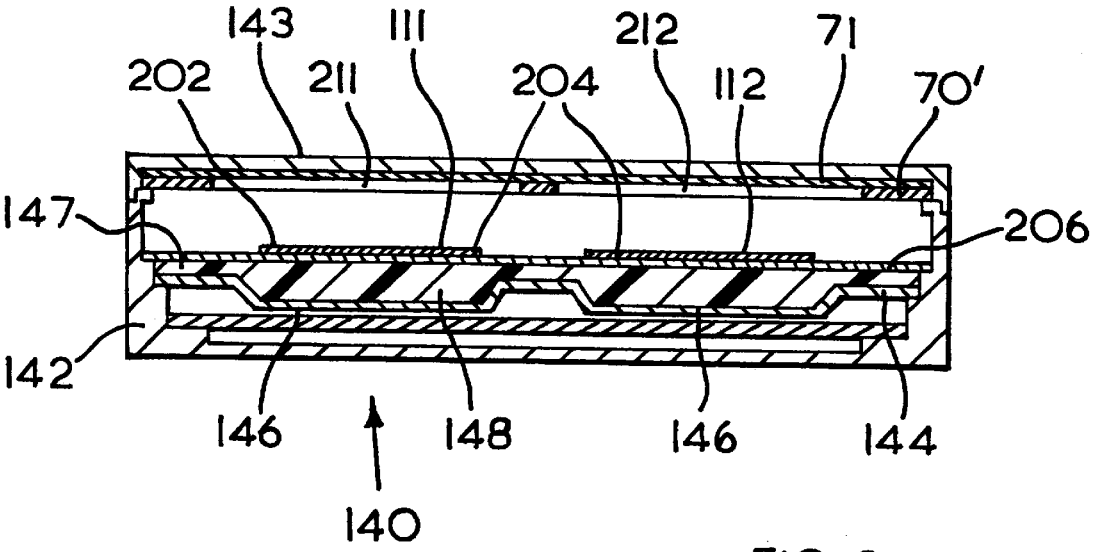
FIG. 8 shows a cross section through a second embodiment of the antenna assembly according to the present invention incorporating the circuit of FIG. 4 and the screen of FIG. 6 embodied as a metal film and taken across plane BB of FIGS. 5 and 6.

Referring particularly to FIG. 8, the screen (70') is made from a 37 micron thick metal film (70') printed onto a thin backing sheet (71) of plastics material.

What is claimed is:

1. A radio frequency antenna arrangement comprising;

at least one radiating element which is located in a circuit with at least one feeder element which couples electromagnetic signals to the radiating element, and an electrically conductive backplate, which forms a groundplane for the circuit, and which is located behind the circuit and separated from the circuit by a dielectric layer, wherein an electrically conductive screen which does not form a groundplane for the circuit is located directly in front of the feeder element or elements to selectively expose the radiating element or elements, which screen is not electrically connected to the backplate and is spaced from the feeder element or elements so that the screen acts like a capacitor to the backplate and does not re-radiate radiation from the feeder element.

2. An antenna arrangement according to claim 1 wherein the spacing between the screen and the feeder element or elements is at least three times greater than the spacing between the feeder element or elements and the backplate.

3. An antenna arrangement according to claim 1 wherein the spacing between the screen and the feeder element or elements is at least four times greater than the spacing between the feeder element or elements and the backplate.

4. An antenna arrangement according to claim 1 wherein the screen is configured to define at least one aperture in the screen and the or each aperture corresponds to and lies directly above the or each radiating element or elements of the circuit.

5. An arrangement according to claim 1 wherein the screen is configured to define at least one aperture in the screen and the or each aperture corresponds to and lies directly above the or each radiating element or elements of the circuit and each aperture in the screen is formed with dimensions which are ⅔ to ⅔ times the equivalent dimensions of the corresponding radiating element.

6. An arrangement according to claim 1 where the dimensions of the screen are not close to multiples of half the wavelength of the range of radio frequency radiation at which the circuit is designed to operate.

7. An arrangement according to claim 1 wherein the or each radiating element is a radiating antenna patch.

8. An arrangement according to claim 1 wherein the circuit comprises a microstrip circuit arrangement.

9. An arrangement according to claim 1 wherein the screen is made of metal.

10. An arrangement according to claim 1 wherein the screen comprises a layer of metal spray painted onto a housing part of the antenna.

11. An arrangement according to claim 1 wherein the screen comprises a metal plate.

12. An arrangement according to claim 1 wherein the screen comprises a metal film.

13. A method of screening a radio frequency antenna arrangement which has at least one radiating element which is located in a circuit with at least one feeder element which couples electromagnetic signals to the radiating element and an electrically conductive backplate, which forms a groundplane for the circuit, and which is located behind the circuit and separated from the circuit by a dielectric layer, comprising the steps of;

locating an electrically conductive screen which does not form a groundplane for the circuit directly in front of the feeder element or elements of the antenna arrangement so as to selectively expose the radiating element or elements, electrically isolating the conductive screen from the backplate, and spacing the conductive screen from the feeder element or elements so that the screen acts like a capacitor to the backplate and does not re-radiate radiation from the feeder elements.

14. A method according to claim 13 comprising the steps of supplying electromagnetic signals to the circuit for transmission by the radiating elements as electromagnetic radiation and coupling electromagnetic signals from the circuit which are generated by the receipt of electromagnetic radiation by the radiating elements.

* * * * *